US005373225A

United States Patent [19]

Poletto et al.

[11] Patent Number: 5,373,225

[45] Date of Patent: Dec. 13, 1994

[54] LOW-DROP VOLTAGE REGULATOR

[75] Inventors: Vanni Poletto, Camino; Marco Morelli, Livorno, both of Italy

[73] Assignee: SGS-Thomson Microelectronics S.r.l., Agrate Brianza, Italy

[21] Appl. No.: 941,665

[22] Filed: Sep. 8, 1992

[30] Foreign Application Priority Data

Sep. 9, 1991 [IT] Italy ..... T091A000688

[51] Int. Cl.[5] ..... G05F 1/56

[52] U.S. Cl. ..... 323/282; 323/351

[58] Field of Search ..... 323/282, 284, 273, 274, 323/349, 351

[56] References Cited

U.S. PATENT DOCUMENTS 4,933,826 6/1990 Person .

5,038,266 8/1991 Callen et al. .

OTHER PUBLICATIONS

EDN Electrical Design News, vol. 29, No. 10, May 1984, Boston, Mass., US, pp. 161–176, Glenn Fritz "Versatile Linear Regulator Eases Power-Supply Design".

EDN Electrical Design News, vol. 33, No. 20, Sep. 29, 1988, Newton, Mass., US, pp. 173–182, Steven C. Hageman, "Spice Techniques Facilitate Analysis of Feedback Circuits".

Millman & Halkias, "Integrated Electronics" 1971, McGraw-Hill, Tokyo, Japan.

*Primary Examiner*—Emanuel T. Voeltz

*Attorney, Agent, or Firm*—Wolf, Greenfield & Sacks

[57] ABSTRACT

A low-drop voltage regulator includes a P-type power transistor having an input terminal connected to a supply source, an output terminal connected to a load, and a control terminal driven by the output of an operational amplifier having its non-inverting input connected to a reference voltage source and its inverting input connected to the output terminal of the power transistor. To improve the regulation characteristics of the regulator without jeopardizing stability, even under normally critical conditions, provision is made for a feedback network including a capacitive component between the output and inverting input of the operational amplifier.

43 Claims, 3 Drawing Sheets

LOW-DROP VOLTAGE REGULATOR

BACKGROUND OF THE INVENTION

1. Field of the Invention

The present invention relates to a low-drop voltage regulator.

2. Background Discussion

Regulators are systems for automatically varying and maintaining a predetermined physical output quantity within a predetermined range despite variations in other disturbance quantities affecting the system.

Such systems typically involve conflicting requirements including those of compensating frequency while at the same time maintaining the accuracy of the system.

The rating parameters normally characterizing automatic regulating systems include:

a. Error. Defined as a variation in the output quantity in relation to a reference input quantity, due to numerous factors affecting mass production of the system, and which must be measured under steady conditions using a definite input quantity configuration.

b. Regulation. Defined as a variation in the output quantity due to variations in disturbance quantities and which must be measured under steady conditions using disturbance quantities varying within a definite range.

c. Settling time. The time taken to restore the output quantity to the correct value following a rapid variation in a disturbance quantity, and which must be measured using a disturbance quantity having a definite variation speed and amplitude.

d. Peak error. Defined as the maximum deviation of the output quantity from its normal operating value, in the presence of a rapid transient disturbance, specified herein as point c, and which must be measured under the same conditions as in point c.

A voltage regulator is a circuit for regulating the voltage applied to loads or user equipment absorbing a limited though not specifically defined amount of current. The load and the regulator are supplied with a supply voltage, and a reference voltage is also available, supplied by a supposedly accurate source, but with a poor current supply capacity. The reference voltage supplied to the regulator represents the quantity with which the output voltage is compared, and the disturbance for the voltage regulator substantially consists of the current supply to the load and the supply voltage, variations in both of which tend to affect the output voltage.

The current market demand is for voltage regulators with extremely good error and regulation characteristics. In fact, the increasingly widespread application of sophisticated control systems in traditionally exacting environments in terms of disturbance and reliability, as is the case with cars, has led to an increasing demand for electronic components conforming to increasingly strict requirements. More specifically, on the one hand, a desired system should be so designed as to prevent partial failure jeopardizing overall operation of the system, whereas a certain amount of degradation is normally acceptable. This desire requires dividing the voltage regulating function into various sections, so as to prevent failure in one which would the others. On the other hand, an increase in the sophistication of the system demands a similar increase in precision, as for example in the case of microprocessor systems involving digital/analog and analog/digital conversion, wherein the integrity of the numeric data depends on the ration of the analog data (ratiometry principle). At the very least, therefore, the regulated voltages must be practically identical, thereby also yielding the above demand for superior error and regulation characteristics.

For transferring power from the supply to the output, voltage regulators employ the power transistors, both N type (bipolar NPN or N-channel MOS) and P type.

Though the first type (featuring N type transistors) is subject to fewer problems of stability, the voltage drop in the power transistor poses limitations in applications in which the supply voltage is close in value to the output voltage.

The second type includes what is known as "low-drop" regulators, which operate satisfactorily even when the supply voltage is extremely close in value to the output voltage, but which present greater frequency stability problems as compared with the first type. To overcome this problem, the device must therefore be provided with a compensating capacitance. Due to the recent demand, however, for limiting radio interference, capacitive elements on regulated voltage lines must present an extremely low equivalent series resistance (ESR). For technical reasons, such capacitors are low value capacitors. Regulated voltage lines are fitted with higher-value capacitors for sustaining loads requiring high instantaneous current, and the ESR of which is necessarily high, particularly at very low temperatures, such as is required for automative applications. The conflicting demand for a high capacitance for improving frequency stability combined with a low ESR for limiting radio interference require trade-offs which inevitably satisfy neither requirement.

A typical prior art low-drop voltage regulator is shown in the circuit diagram of FIG. 1, wherein number 1 indicates a known regulator having an input terminal 2 connected to a supply voltage 3 of value Va; and an output terminal 4 connected to a load 5. Regulator 1 comprises a P-type power transistor 6, in this case a bipolar PNP transistor, having the emitter connected to input terminal 2, and the collector connected to output terminal 4. The base of power transistor 6 is driven by an error comparator, consisting of a current-output, low-voltage-gain, operational amplifier 10, via a high-input-impedance drive transistor 11 and a resistor 12. More specifically, operational amplifier 10 has its non-inverting input connected to a voltage source 13 supplying reference voltage $V_R$ and its inverting input connected to output terminal 4. The output of operational amplifier 10 is connected to the base of drive transistor 11, here represented by a bipolar NPN transistor, but generally consisting of more complex (e.g. Darlington) configurations for increasing input impedance. The collector of drive transistor 11 is connected to the base of power transistor 6, while the emitter is grounded (reference potential line) via resistor 12. For frequency stability reasons, an impedance 15 of value $Z_c$ is provided between the output of operational amplifier 10 and ground and between output terminal 4 and ground. Provision is made for a capacitor 16 which, requiring a value of at least 10 $\mu$F, must be electrolytic. Unfortunately, the above capacitors present a significantly high ESR, which increases with a fall in temperature, and which, are represented symbolically in FIG. 1 by resistor 17. Such capacitors 16 negatively affect the frequency stability of regulator 1, which is thus limited to other than very low temperature applications.

In FIG. 1, an error voltage $V_e$ is present between in inputs of operational amplifier 10, and represents the difference between reference voltage $V_R$ and output voltage $V_u$. If $V_c$ is the output voltage and $g_m$ is the transconductance of operational amplifier 10, voltage $V_c$ can be derived by the following formula:

$$V_c = V_e * g_m * Z_c,$$

thus giving a voltage gain of operational amplifier 10 of $g_m * Z_c$. Under normal (d.c.) operating conditions, the gain of operational amplifier 10 is generally relatively low, ranging from 100 to 500. Indeed, for frequency stability reasons, gain must necessarily be low and impedance $Z_c$ presents a capacitive frequency compensating using a capacitor of limited value (more specifically, integratable), the capacitor, which is located between the output of operational amplifier 10 and ground or the supply line, is connected between the base and collector of a transistor for amplifying its capacitance. For all of its effectiveness, such a technique is fairly empirical, in that the value $Z_c$ of known devices cannot be expressed in the form of an analytical function straightforward enough to enable the use of automatic control theories.

Output voltage $V_c$ is supplied to the base of high-input-impedance drive transistor 11 and, via resistor 12, is converted into the current $I_b$ designated by the following formula: $I_b = V_c/R$, where "R is the resistance of resistor 12, which current, from the base of power transistor 6, is multiplied by gain B of transistor 6 to give output current $I_u$ designated by the following formula:

$$I_u = B * I_b.$$

A quantitative estimate of the error and regulation characteristics of the known regulator in FIG. 1 can be made as follows. Assuming, as is normally the case, a value of 5 V for $V_R$ and $V_u$, when $I_u$ varies from a minimum value of O A to a maximum value which need not be defined, the base current $I_b$ of power transistor 6, which is directly proportional to the output current, also switches from a minimum (O A) to a maximum. To maximize efficiency of the capacitive component $Z_c$ of impedance 15, for achieving effective frequency compensation and compactness (small integration area), resistance R of resistor 12 must be maximized as described below, and such that its maximum voltage, corresponding to maximum current $I_b$, is as high as possible, compatible with operation of drive transistor 11 and supply voltage $V_a$, supply voltage $V_a$ reaches the required minimum value $V_{a(min)}$ where, $$V_{a(min)} = V_u + V_{ce6(sat)}$$

where $V_{ce6(set)}$ is the voltage between the collector and emitter of power transistor 6 when saturated.

Under such conditions, $V_c$, which is normally expressible as follows:

$$V_c = V_{bell} - V_{cell} - V_{be6} + V_a$$

where $V_{bell}$ and $V_{cell}$ are respectively the base-emitter and collector-emitter voltage drop of drive transistor 11, and $V_{be6}$ is the base-emitter voltage drop of power transistor 6, presents a maximum possible value $V_{c(max)}$ where, $$V_{c(max)} = V_{bell} - V_{cell(sat)} - V_{be6} + V_{a(min)}$$

or, $$V_{c(max)} = V_{bell} - V_{cell(sat)} - V_{be6} + V_u + V_{ce6(sat)}$$

where $V_{cell(sat)}$ is the collector-emitter voltage drop of transistor 11 when saturated.

Roughly, $V_{bell} = V_{be6}$, and $V_{cell(sat)} = V_{ce6(sat)}$ yielding 1.

$$V_{c(max)} = V_u = 5 \text{ V}.$$

When $V_c = O$ and $I_b = O$, $V_c$ is within a range of 5 V, and $V_e$, which is supplied to operational amplifier 10, is within a range of 5 V/500=10 mV or 5 V/100=50 mV (depending on whether the gain of operational amplifier 10 is 500 or 100, respectively.

The need for maximizing resistance R of resistor 12 is explained as follows. Approximately the impedance $Z_c$ with its capacitive component C, yields $Z_c = 1/sC$, so that the transfer function F, the input and output of which are respectively represented by the current from operational amplifier 10 and current $I_b$, equals 1/sCR. Since this function depends on the product of R and C, for a given transfer function, to minimize C and so reduce the size of capacitor C (as required for integrated applications), R must be maximized.

Known regulators of the aforementioned type therefore provide for load and line regulation ranging from 10 mV to 50 mV, which fails to conform with current requirements in terms of precision.

The same failure also applies to the error characteristic. In fact, all the "errors" generated downstream from operational amplifier 10 are supplied to its input and divided by the relatively low gain of the amplifier. In the case of base current $I_b$, for example, this may vary substantially, up to 100%, due to mass production spread, which variation, divided by $g_m$, becomes the variation in the voltage $V_e$ required for error correction. Being independent of external variables, such as $V_a$ and $I_u$, this variation voltage may even be as high as 10 mV, which is added to the various regulation components mentioned above for determining the total difference between required voltage $V_R$ and actual voltage $V_u$.

It is, therefore, a general object of the present invention to provide a low-drop voltage regulator having improved error, regulation and speed performance characteristics, and which provides for frequency stability using a low-value, low-ESR, radiofrequency output capacitor.

SUMMARY OF THE PRESENT INVENTION

According to the present invention, there is provided a low-drop voltage regulator comprising a power element having an input terminal coupled to a supply voltage source, an output terminal coupled to a load, and a control terminal. The regulator further includes an error comparator having a first input coupled to a reference voltage source, a second input coupled to the output terminal, and an output coupled to the control terminal. The low-drop regulator further includes a feedback network, having a reactance, coupled between the output and the second input of the error comparator.

BRIEF DESCRIPTION OF THE DRAWINGS

A preferred, non-limiting embodiment of the present invention will be described by way of example with reference to the accompanying drawings, in which.

DETAILED DESCRIPTION

Figure 1:
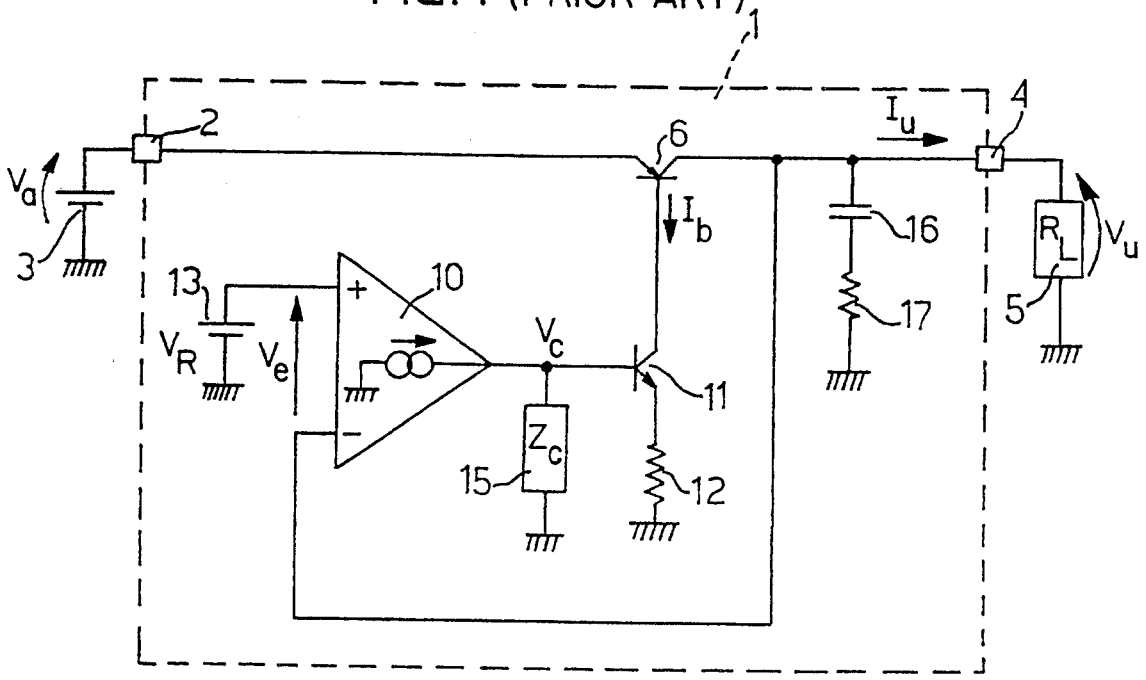
FIG. 1 (PRIOR ART)
FIG. 1 shows a simplified circuit diagram typical of know prior art regulators.
Figure 2:
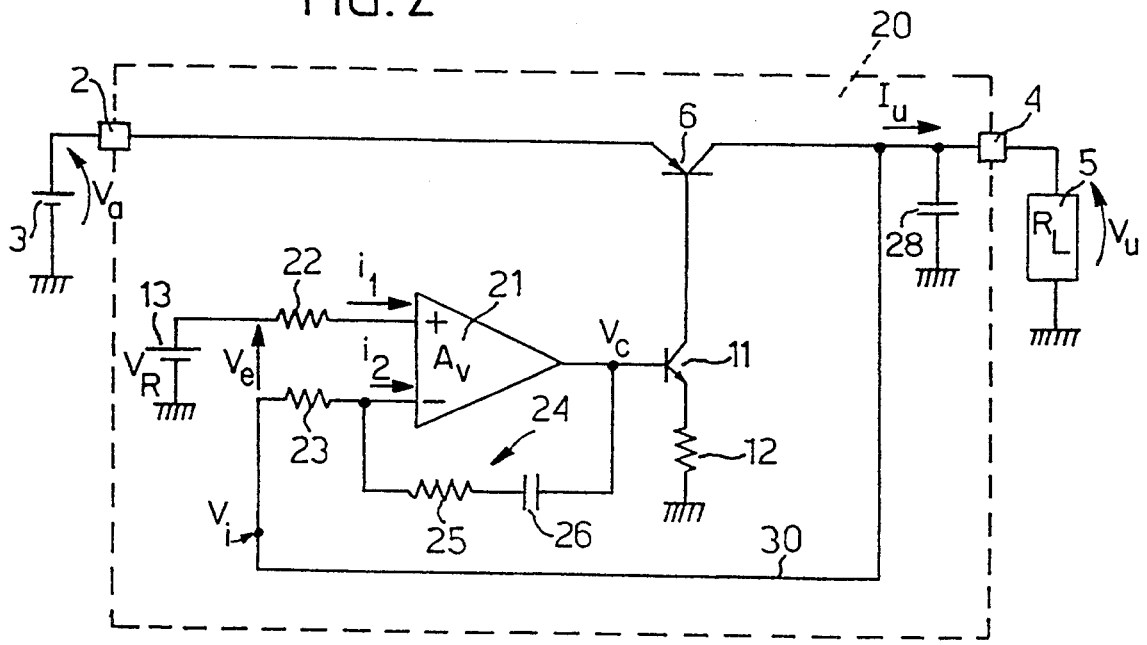
FIG. 2 shows a circuit diagram of a regulator according to the present invention.

FIG. 2, in which the elements common to those of the prior art regulator in FIG. 1 are indicated using the same numbering system, shows a regulator 20 according to the present invention, which presents an input terminal 2 connected to supply voltage 3; an output terminal 4 connected to a load 5; and, as with the prior art regulator, an error comparator 21, a drive transistor 11, a resistor 12 and a power transistor 6 defining the feedback loop of the regulator.

Unlike the prior art regulator, error comparator 21 actually consists of an operational amplifier, i.e. a voltage amplifier produced in a known manner and having an extremely high gain $A_v$ (i.e. 80 dB=10000) and a low-impedance output. The non-inverting input (+) of operational amplifier 21 is connected to source 13 of reference voltage $V_R$ via a resistor 22 of value $R_1$, while the inverting input (−) is connected to output terminal 4 via another resistor 23 of value $R_2$, preferably equal to $R_1$.

According to the present invention, between the output and inverting input of operational amplifier 21, provision is made for a feedback network 24 consisting preferably of the series connection of a resistor 25 of value $R_3$ and a capacitor 26 of value $C_1$, which provides for frequency compensating the regulating loop, as described in detail hereinafter. Also, between output terminal 4 and ground, a small capacitor 28 of value $C_2$ is provided for improving frequency stability and response of the regulator to instantaneous variations in load current.

As a high input impedance is no longer required of the drive transistor, by virtue of it being adequately driven by low-impedance-output operational amplifier 21, transistor 11 of regulator 20 consists of a single real transistor, as opposed to the more complex configuration, typical of known regulators.

On regulator 20 in FIG. 2, drops $R_1*i_1$ and $R_2*i_2$ are respectively subtracted from and added to error voltage $V_e$ (the difference between reference voltage $V_R$ and output voltage $V_u$), and the resulting voltage is supplied to the inputs of operational amplifier 21. As input currents $i_1$ and $i_2$ of the amplifier, however, are normally very small and similar to each other, and $R_1=R_2$, drop $(R_2*i_2-R_1*i_1)$ is roughly negligible, so that the difference in potential applied to the inputs of operational amplifier 21 remains substantially equal to $V_e$.

Amplifier 21, therefore, amplifies error voltage $V_e$ by gain $A_v$ to produce a low-impedence-output voltage $V_c=V_e*A_v$, but only under normal operating conditions, i.e. with zero frequency.

As on known regulators, voltage $V_c$ is converted into current $I_b$ via drive transistor 11 and resistor 12, and multiplied by gain B of power transistor 6 to produce output current $I_u$.

To evaluate the frequency response of the regulator, the regulating loop comprising components 21, 11, 12 and 6 must be opened by disconnecting output terminal 4 and resistor 23 (line 30). Once opened, when a signal $V_i$ is applied to the then free terminal of resistor 23, voltage $V_c$ becomes $$V_c=-V_i(1+sC_1R_3)/(sC_1R_2) \quad (1)$$

Voltage $V_c$ is then applied to resistor 12 via transistor 11, which acts as a voltage follower, to give:

$$I_b=V_c/R \quad (2)$$

Current $I_b$ is in turn amplified by gain B of power transistor 6 and injected into capacitor 28 of value $C_2$ (disregarding load 5) to give an output voltage of:

$$V_u=B*I_b/(sC_2) \quad (3)$$

Figure 3:
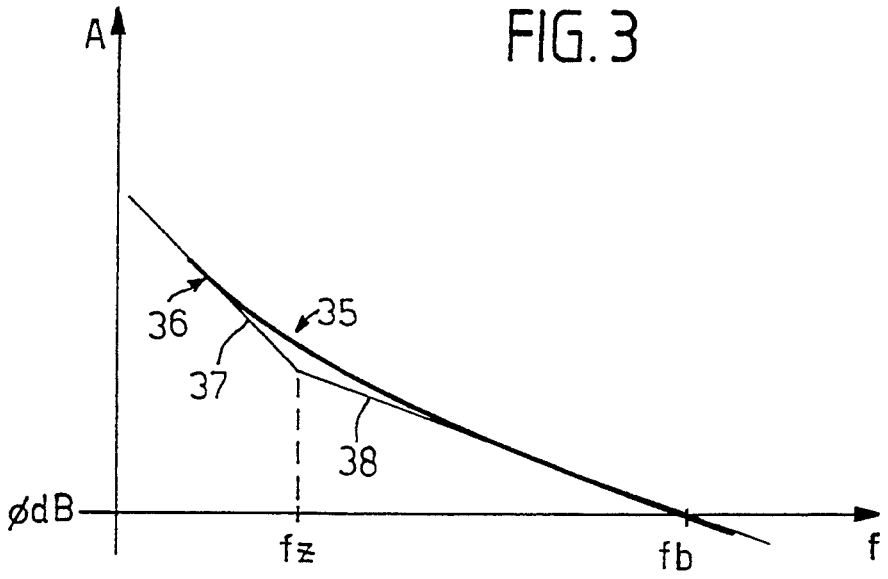
FIGS. 3–6 show Bode diagrams of the frequency and loop gain of a regulator of the present invention at various levels of approximation.

Formulas (1), (2), and (3) combine to give the loop transfer function of the regulator as a whole, which is:

$$V_u/V_i=-B(1+sC_1R_3)/(s^2C_2C_1RR_2), \quad (4)$$

the amplitude (or loop gain) of which presents the frequency shown in the FIG. 3 Bode diagram. In this diagram, the low-frequency asymptote is calculated assuming:

$$(1+sC_1R_3)=1$$

to give:

$$V_u/V_i(s->0)=-B/(s^2C_2C_1RR_2),$$

which presents a −40 dB/dec slope produced by the $1/s^2$ term; while the high-frequency asymptote is calculated assuming:

$$(1+sC_1R_3)=(sC_1R_3)$$

to give:

$$V_u/V_i(s=>\infty)=-(R_3/R_1)*B(sC_2R),$$

which presents a −20 dB/dec slope produced by the 1/s term. Also, a transmission zero is generated at frequency $f_z$ defined by:

$$f_z=1/(2\pi R_3C_1), \quad (5)$$

by feedback network 24; and the 0 dB axis is crossed at frequency $f_b$ defined by:

$$f_b=(R_3/R_2)*(B/2\pi C_2R), \quad (6)$$

with a slope of −20 dB/dec, to ensure the frequency stability of the regulator.

In FIG. 3, therefore, gain (which is actually shown by thicker curve 35) may be represented schematically by thin broken line 36, which comprises a first straight, −40 dB/dec, portion 37 as far as zero $F_z$, and a second straight, −20 dB/dec, portion 38 crossing the 0 dB axis at frequency $f_b$.

Though various factors are omitted in equation (4) relative to gain $V_u/V_i$, this in no way affects the accuracy of frequencies $f_z$ and $f_b$ as per equations (5) and (6), and the distance between these frequencies indicates the margin within which may fall without the −40 dB/dec portion crossing the O dB axis, which would impair stability. Moreover, the distance between $f_b$ and the first parasitic pole (not considered in FIG. 3), encountered as frequency rises, indicates the margin within which gain may increase without the −40 dB/dec portion, introduced by the parasitic pole, crossing the O dB axis.

Figure 4:
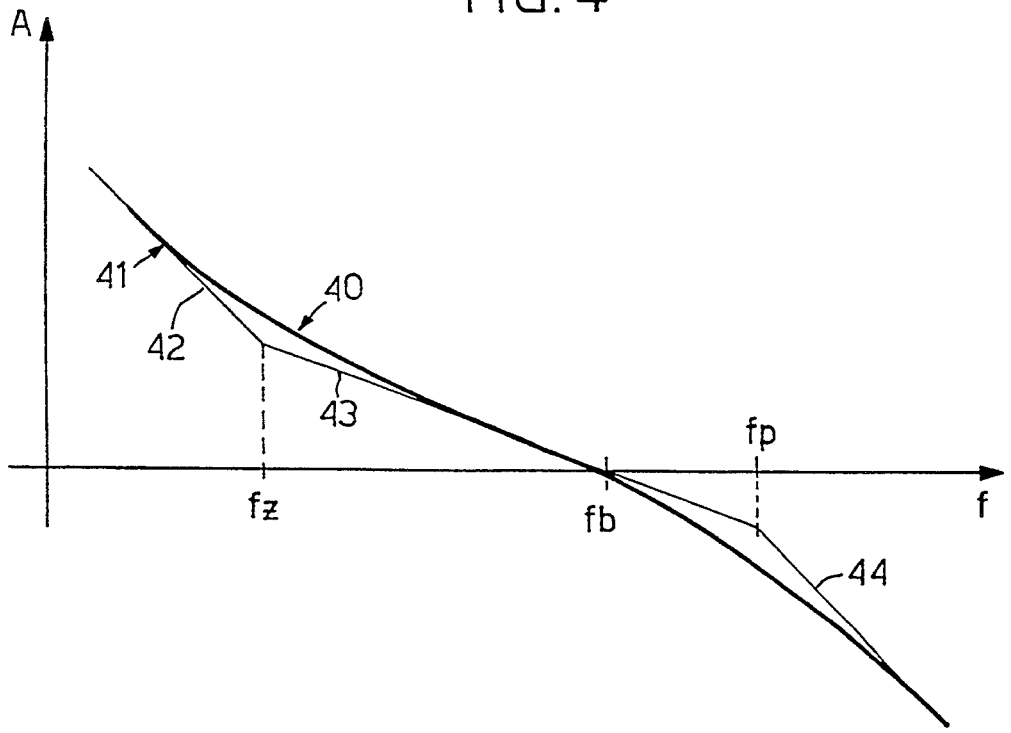

The FIG. 4 Bode diagram shows the effect of the parasitic pole, indicated by $f_p$. As can be seen the real curve, shown by line 40, may be approximated by broken line 41 consisting of the asymptotes and comprising a first, −40 dB/dec, portion 42 up to zero frequency $f_z$; a second, −20 dB/dec, portion 43 between zor $f_z$ and parasitic pole $f_p$, and including frequency $f_b$; and a third, −40 dB/dec, portion 44 above parasitic pole $f_p$.

Parasitic pole $f_p$ is preferably generated by limiting the passband of operational amplifier 21, which is controllable to a fairly high degree of accuracy using simple known techniques, so that it is below the parasitic pole frequencies of all the other elements in the regulating loop; in particular, transistors 6 and 11.

Figure 5:
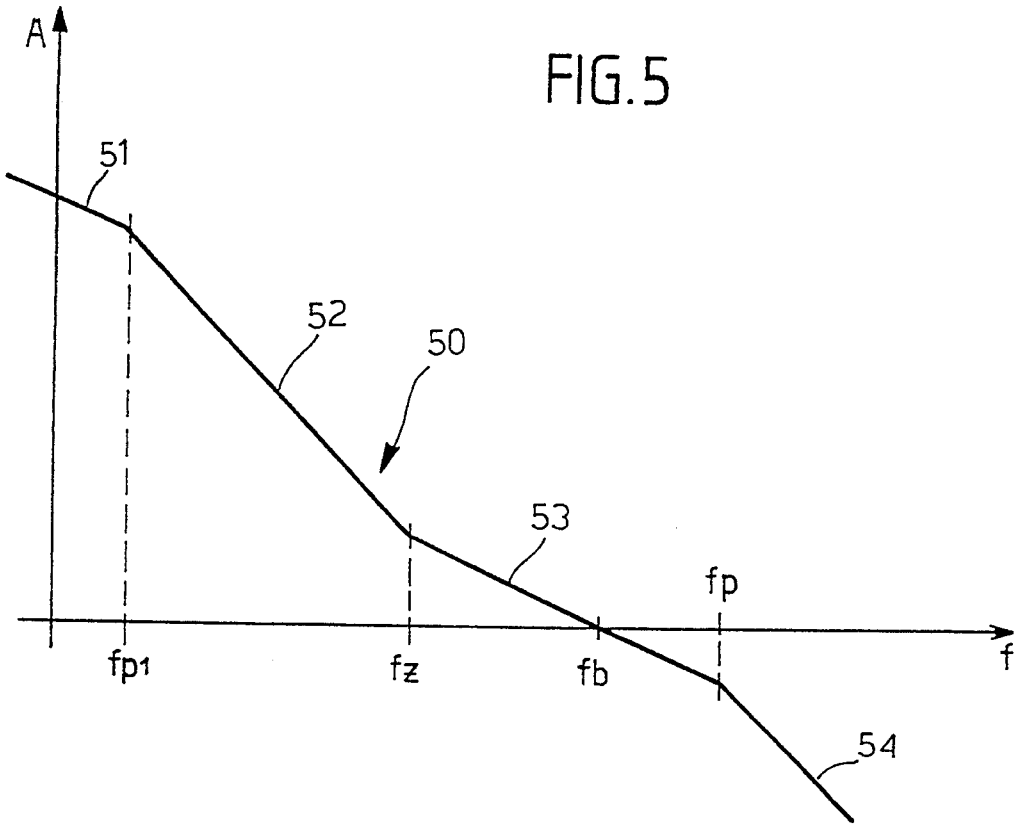

FIG. 5 shows the Bode diagram at a higher level of approximation, i.e. taking into account the low-frequency parasitic pole $f_{pl}$ limiting the low-frequency gain of the operational amplifier. As can be seen, the lower-frequency upstream portion of the diagram upstream from pole $f_{pl}$ is modified, whereas the higher-frequency downstream portion remains unaffected. The real curve (not shown in FIG. 5), therefore, presents asymptotes defined by broken line 50, which comprises a first, −20 dB/dec, portion 51 up to low-frequency parasitic pole $F_{pl}$ a second, −40 dB/dec, portion 52 between $f_{pl}$ and zero $f_z$; a third, −20 dB/dec, portion 53 between zero $f_z$ and parasitic pole $f_p$, and including frequency $F_b$; and a third, −40 dB/dec, portion 44 above parasitic pole $f_p$.

Parasitic pole $f_p$ is preferably generated by limiting the passband of operational amplifier 21, which is controllable to a fairly high degree of accuracy using simple known techniques, so that it is below the parasitic pole frequencies of all the other elements in the regulating loop; in particular, transistors 6 and 11.

FIG. 5 shows the Bode diagram at a higher level of approximation, i.e., taking into account the low-frequency parasitic pole $f_{pl}$ limiting the low-frequency gain of the operational amplifier. As can be seen, the lower-frequency upstream portion of the diagram upstream from pole $f_{pl}$ is modified, whereas the higher-frequency downstream portion remains unaffected. The real curve (not shown in FIG. 5), therefore, presents asymptotes defined by broken line 50, which comprises a first, −20 dB/dec, portion 51 up to low-frequency parasitic pole $f_{pl}$; a second, −40 dB/dec, portion 52 between $f_{pl}$ and zero $f_z$ and parasitic pole $f_p$, and including frequency $f_b$; and a fourth, −40 dB/dec, portion 54 above parasitic pole $f_p$.

Figure 6:
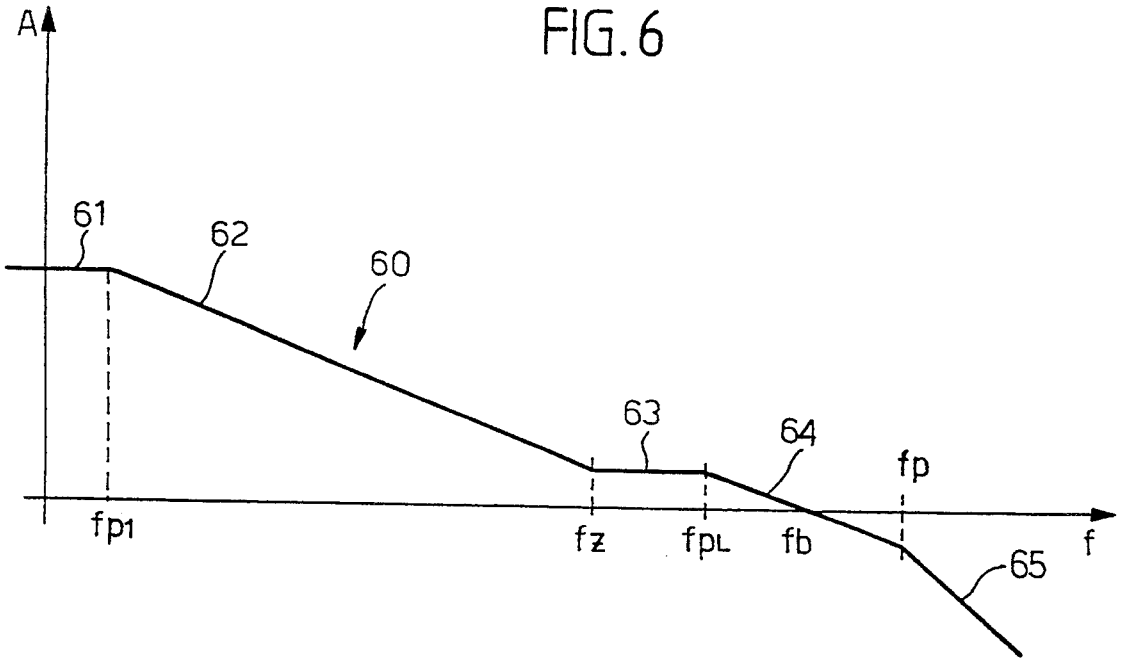

FIG. 6 shows the effect of load resistance $R_L$ at the output, which, parallel to capacitor 28, produces frequency pole $f_{pL}$ defined by:

$$f_{pL}=1/(2\pi C_2 R_L).$$

At frequencies above $f_{pL}$, the impedance of capacitor C2 is lower than $R_L$, which is, thus, negligible and has no effect on the Bode diagram. As a result, the slopes of all the frequencies below $f_{pL}$ in FIG. 5 are increased by 20 dB/dec, while the higher frequency slopes remain unchanged, as shown by broken line 60 in FIG. 6. In FIG. 6, the load pole is assumed to lie between $f_z$ and $f_b$, and line 60 comprises a first, horizontal, portion 61 up to low-frequency parasitic pole $f_{pl}$; a second, −20 dB/dec, portion 62 between $f_{pl}$ and zero $f_z$ and parasitic pole $f_{pL}$ produced by-the load; a fourth, −20 dB/dec, portion 64 between parasitic pole $f_{pL}$ and high-frequency parasitic pole $f_p$, and including frequency $f_b$; and a fifth, −40 dB/dec, portion 65 above parasitic pole $f_p$.

Though the assumed location of $f_{pL}$ between $f_z$ and $f_b$ in FIG. 6 does not necessarily hold true in practice, it can easily be demonstrated that the O dB axis is nevertheless crossed at a −20 dB/dec slope regardless of the location of $f_{pL}$.

Another point to note is that, providing $f_{pL}$ is below $f_b$, the significance of $f_b$ as compared with the simplified diagram in FIG. 3 remains unchanged (i.e. the distance between $f_b$ and $f_p$ indicates the margin within which gain may increase without jeopardizing the stability of the regulator). Similarly, providing $f_{pL}$ is below $f_z$ (in contrast to the FIG. 6 diagram), the significance of $F_z$ in FIG. 3 also remains unchanged (i.e. the distance between $f_z$ and $f_b$ indicates the margin within which gain may fall without jeopardizing the stability of the regulator).

The following is a non-limiting list of preferable component sizes:

$R_1=R_2=R_3=100$ KΩ
$C_1=50$ pF
$R=100\Omega$
$B=50$
$C_2=100$ nF

Operational amplifier 21 is preferably used with the following typical parameters:

$A_v=10000=80$ dB (low-frequency gain)
$f_p=1$ MHz (passband)
$f_{pl}=100$ HZ (low-frequency pole), wherein, the zero and and frequencies $f_z$ and $f_b$ of the regulator work out to be:

$f_z=32$ KHz $f_b=800$ KHz.

These parameters provide for meeting all the frequency stability conditions, and for enabling loop gain to fall safely by a total of $f_p/f_b=25$ and to increase safely by $f_p/f_b=1.25$ using no more than a 100 nF radio frequency capacitor C, and with no need, though no harm would be done if used, for a higher value capacitor connected in parallel to capacitor C. The regulator according to the present invention may therefore be fitted with one or more additional electrolytic output capacitors, as is customary for enabling peak current supply. Under certain conditions (low temperature), in fact, The ESR of such capacitors reaches such a high value that the capacitors are disconnected from the output of the regulator.

The error characteristic of the regulator is substantially due to the offset voltage at the input of operational amplifier 21, and a minor difference in the drop of resistors 22 and 23 supplied with currents $i_1$ and $i_2$. Only a small amount of error is involved, however, by virtue of the very small offset voltage (normally 4 mV) of commercial operational amplifiers, which may be further reduced in any known manner at the integration stage.

The load current regulation characteristic is shown by the fact that the maximum range of current $I_u$ requires a maximum range of voltage $V_c$ (typically 5 V), as with known regulators. When divided by the typical gain $A_v=10000$ of operational amplifier 21, the maximum range yields 0.5 mV, i.e. the corresponding range of $V_e$, which is a typical load current as well as supply voltage regulating value.

The superior static characteristics described above are mainly due to the fact that the compensating technique, via feedback to the operational amplifier, according to the present invention, enables the error comparator to consist of an operational amplifier with an extremely high gain at the input stage. Consequently, any errors or interference introduced downstream from the input stage are divided by the high gain of the amplifier to give the low values shown above, and, what is more, without jeopardizing the stability of the regulator, the loop gain of which depends, not directly on gain $A_v$ of the amplifier (as on known regulators), but on the circuit consisting of the amplifier and feedback network. This circuit may thus be sized so that, even with a high gain $A_v$, the loop gain of the regulator crosses the 0 dB axis with a slope of −20 dB/dec.

The advantages of the regulator according to the present invention will be clear from the foregoing description, and include:

A straightforward design. The FIG. 2 diagram is more or less complete and not a schematic one, as opposed to that of the prior art regulator in FIG. 1.

Compactness. The regulator according the present invention may be produced in discrete form using a small number of commercial components, or in compact integrated form.

Precision. The output voltage matches the input voltage to within less than 10 mV, including all regulations and the error characteristic, and under all possible steady load, supply, temperature and varying production parameter conditions.

Versatility. The high degree of stability of the regulator according to the present invention enables it to be employed under normally critical conditions, such as low temperature or in the presence of electromagnetic interference. In the case of low temperature applications, electrolytic capacitors for stabilizing frequency are no longer required (and may thus either be dispensed or reduced in value), while small capacitors with a very low ESR may be employed in the presence of electromagnetic interference.

Speed. The loop transfer function may be established easily to a high degree of precision, by virtue of the same applying to all its coordinates, even the first pole $f_p$ occurring beyond cutoff frequency $f_b$ which is normally a parasitic pole that is extremely difficult to locate. An exception to this is the low-frequency pole $f_{pl}$, which nevertheless has no effect on the frequency stability of the regulator. The present invention therefore, provides for optimizing the response without incurring oscillation problems.

To those skilled in the art, it will be clear that changes may be made to the regulator as described and illustrated herein without departing from the spirit of the present invention. For example, though the feedback network, for various reasons, preferably consists of a capacitor and resistor, the reactance of the network may be provided by other components such as inductive elements. Also, connection of the operational amplifier may be other than as shown, providing that the feedback connections provide for frequency stabilization and regulation as required.

The foregoing description is provided by way of example only and is no way meant to limit the scope of the present invention which is defined by the appended claims and their equivalents.

What is claimed is:

1. A low-drop voltage regulator comprising:

a power element having an input terminal coupled to a supply voltage source, an output terminal coupled to a load, and a control terminal;

an error comparator having a first input coupled to a reference voltage source, a second input coupled to the output terminal of the power element, and a low-impedance output coupled to the control terminal; and a feedback network, having a reactance, connected between the low-impedance output and the second input of the error comparator.

2. A low-drop voltage regulator as set forth in claim 1, wherein the power element is a P-type power element.

3. A low-drop voltage regulator as set forth in claim 1, wherein the feedback network includes a resistor and a capacitor connected in series.

4. A low-drop voltage regulator as set forth in claim 1, wherein the error comparator includes a voltage amplifier.

5. A low-drop voltage regulator as set forth in claim 3, wherein the error comparator includes a voltage amplifier.

6. A low-drop regulator as set forth in claim 4, wherein the voltage amplifier includes an operational amplifier having a non-inverting input coupled to the reference voltage source, an inverting input coupled to the output terminal of the power element, and an output coupled to the low-impedance output.

7. A low-drop regulator as set forth in claim 5, wherein the voltage amplifier includes an operational amplifier having a non-inverting input coupled to the reference voltage source, an inverting input coupled to the output terminal of the power element, and an output coupled to the low-impedance output.

8. A low-drop voltage regulator as set forth in claim 6, further comprising a drive element coupled between the low-impedance output of the error comparator and the control terminal of the power element.

9. A low-drop voltage regulator as set forth in claim 7, further comprising a drive element coupled between the low-impedance output of the error comparator and the control terminal of the power element.

10. A low-drop voltage regulator as set forth in claim 8, further comprising a first resistive element coupled between the second input of the error comparator and the output terminal.

11. A low-drop voltage regulator as set forth in claim 9, further comprising a first resistive element coupled between the second input of the error comparator and the output terminal.

12. A low-drop voltage regulator as set forth in claim 11, further comprising a second resistive element coupled between the second input of the error comparator and the reference voltage source, and wherein the first and second resistive elements have substantially the same value.

13. A low-drop voltage regulator as set forth in any of claims 1–12, further comprising a low-value, capacitive element connected between the output terminal and a reference potential line.

14. A low-drop voltage regulator comprising:

modulating means, operative in response to a drive signal, for modulating a flow of current between a voltage supply and an output terminal to generate an output signal;

control means for varying the drive signal in proportion to the output signal, said control means including:

means for generating a low source-impedance control signal;

a drive stage that generates the drive signal in response to the control signal; and coupling means for coupling the drive stage and the means for generating; and a feedback path including a reactance coupled between the output terminal and the coupling means.

15. A low-drop voltage regulator as set forth in claim 14, wherein the modulating means includes a P-type transistor.

16. A low-drop voltage regulator as set forth in claim 14, wherein the feedback path includes a resistor and a capacitor connected in series.

17. A low-drop voltage regulator as set forth in claim 16, wherein the control means includes a voltage amplifier.

18. A low-drop voltage regulator as set forth in claim 17, wherein the voltage amplifier includes an operational amplifier having a non-inverting input coupled to a reference signal, an inverting input coupled to the output terminal, and an output, and wherein the feedback path is coupled between the inverting input and output of the operational amplifier.

19. A low-drop voltage regulator as set forth in claim 14 wherein the drive stage comprises a single drive transistor connected between the output of the operational amplifier and the modulating means.

20. A low-drop voltage regulator as set forth in claim 18, further comprising a first resistive element coupled between the inverting input of the operational amplifier and the output terminal.

21. A low-drop voltage regulator as set forth in claim 20, further comprising a second resistive element coupled between the non-inverting input of the operational amplifier and the reference voltage source, and wherein the first and second resistive elements have substantially the same value.

22. A low-drop voltage regulator as set forth in any of claims 14–21, further comprising a low-value capacitive element coupled between the output terminal and a reference potential line.

23. A low-drop voltage regulator comprising:

a power element having an input terminal coupled to a supply voltage source, an output terminal coupled to a load, and a control terminal;

an error comparator having at least one reference input coupled to a reference source, at least one feedback input coupled to the output terminal of the power element, and a voltage-source output; and a single drive transistor, coupled between the low-impedance voltage-source output and the control terminal.

24. The low-drop voltage regulator of claim 23, wherein the power element is one of a P-type and an N-type, and the single drive transistor is the other of the P-type and N-type.

25. The low-drop voltage regulator of claim 23, further comprising a feedback network coupled between the output of the error comparator and the at least one feedback input of the error comparator.

26. The low-drop voltage regulator of claim 25, wherein the feedback network comprises a resistor and a capacitor connected in series.

27. The low-drop voltage regulator of claim 26, further comprising a resistor coupled between the output terminal and the at least one feedback input.

28. The low-drop voltage regulator of claim 23, wherein the error comparator comprises an operational amplifier which acts as a voltage source.

29. The low-drop voltage regulator of claim 1, further comprising a drive element connected between the low-impedance output of the error comparator and the control terminal of the power element.

30. The low-drop voltage regulator of claim 29, wherein the drive element includes one and not more than one transistor.

31. The low-drop voltage regulator of claim 30, wherein:

the power element includes a transistor that is one of a P-type and N-type, and wherein the drive element transistor is the other of the P-type and N-type.

32. The low-drop voltage regulator of claim 1, further comprising a first resistor coupled between the output terminal and the second input of the error comparator.

33. The low-drop voltage regulator of claim 32, wherein the feedback network includes a resistor and a capacitor connected in series.

34. The low-drop voltage regulator of claim 33, further comprising a second resistor coupled between the reference voltage source and the first input of the error comparator, the first and second resistors having substantially equal resistances.

35. The low-drop voltage regulator of claim 34, further comprising a drive element coupled between the low-impedance output of the error comparator and the control terminal of the power element, the drive element including one and not more than one transistor.

36. The low-drop voltage regulator of claim 12, wherein the drive element includes a transistor of a first type and the drive transistor is of a second type, the first and second types being different.

37. The low-drop voltage regulator of claim 36, wherein the first type is P-type.

38. A low-drop voltage regulator comprising:

a power element having an input terminal coupled to a supply voltage source, an output terminal coupled to a load, and a control terminal;

an error comparator having a first input coupled to a reference voltage source, a second input coupled to the output terminal, and an output coupled to the control terminal; and a compensation network, including a resistor connected in series with a capacitor, coupled between the output and second input of the error comparator.

39. The low-drop voltage regulator as set forth in claim 38, wherein the error comparator comprises a voltage amplifier.

40. The low-drop voltage regulator as set forth in claim 39, wherein the voltage amplifier comprises an operational amplifier having a voltage-source output.

41. The low-drop voltage regulator as set forth in claim 40, further comprising a low-value capacitive element coupled between the output terminal and a reference potential line.

42. The low-drop voltage regulator as set forth in claim 41, wherein the capacitive element has a low equivalent series resistance.

43. The low-drop voltage regulator as set forth in claim 38, further comprising a resistor coupled between the output terminal of the power element and the second input of the error comparator.

* * * * *